United States Patent [19]

Kreutz et al.

[11] 4,149,109

[45] Apr. 10, 1979

[54] LOCATION-SENSITIVE PROPORTIONAL COUNTER TUBE

[75] Inventors: Werner Kreutz, Staufen; Manfred Henne, Blaustein-Herrlingen; Jurgen Fritz, Umkirch, all of Fed. Rep. of Germany

[73] Assignee: M. Braun GmbH, Oberschleissheim, Fed. Rep. of Germany

[21] Appl. No.: 846,124

[22] Filed: Oct. 27, 1977

[30] Foreign Application Priority Data

Oct. 28, 1976 [DE] Fed. Rep. of Germany ..... 2649192

[51] Int. Cl.[2] ..... H01J 17/34; H01J 39/29

[52] U.S. Cl. ..... 315/58; 250/379; 250/382; 313/93; 313/274; 313/324

[58] Field of Search ..... 313/93, 274, 324; 250/374, 379, 382; 315/58

[56] References Cited

U.S. PATENT DOCUMENTS

| | | | |
|---|---|---|---|
| 2,494,641 | 1/1950 | Anderson et al. | 313/93 |
| 2,586,836 | 2/1952 | Liebson | 313/93 |
| 2,921,216 | 1/1960 | Chubb | 313/93 X |
| 3,092,747 | 6/1963 | Fine et al. | 313/93 |
| 3,177,363 | 4/1965 | Scherbatskoy | 313/93 X |
| 3,250,937 | 5/1966 | Woodworth et al. | 250/379 X |
| 3,296,478 | 1/1967 | Ichinokawa | 313/93 |
| 3,316,434 | 4/1967 | Hansen | 313/93 |
| 3,396,300 | 8/1968 | Bowyer | 313/93 |
| 3,560,746 | 2/1971 | Lansiart et al. | 313/93 X |
| 4,053,777 | 10/1977 | Berger et al. | 250/374 X |

*Primary Examiner*—Palmer C. Demeo

*Attorney, Agent, or Firm*—Scully, Scott, Murphy & Presser

[57] ABSTRACT

A location- or positionally-sensitive proportional counter tube of high resolution having a trough-shaped cathode in a counting chamber. A resiliently elastic wire forming the anode extends longitudinally through the counting chamber. Suitable fastening arrangements engage the ends of the wire so as to mount the wire equidistantly from the side walls of the cathode trough and in electrical communication with the input resistor of a preamplifier. The counting chamber is an openable high-pressure chamber with inlet and outlet apertures for a pressurized counter tube gas.

9 Claims, 3 Drawing Figures

LOCATION-SENSITIVE PROPORTIONAL COUNTER TUBE

BACKGROUND OF THE INVENTION

1. Field of the Invention

The present invention relates to a positionally- or location-sensitive proportional geiger or counter tube of high resolution with a counting chamber which is lined with a trough-shaped metallic layer introduced in or vapor-deposited on an insulating body as a cathode, which is gas-tightly covered on its longitudinal side through the intermediary of a conductive and radiation-transmissive foil as a counter tube window, and traversed along its longitudinal direction by a counter tube wire forming an anode and which is maintained stretched equidistantly from the metallic side trough walls, and which is fastened at both sides thereof in the insulating body and connected with the electrical elements of amplifiers.

2. Discussion of the Prior Art

Heretofore, for the registration of X-ray diffraction diagrams it has been the common practice to employ a photographic film. However, a darkened photographic film is subject to a relatively high "background noise" and, within its narrow linear range, to a "dynamic range" of only 1:10. As a result, for spectra having a strongly fluctuating intensity distribution a plurality of exposures must be taken with, at least partly, extremely lengthy exposure periods.

As an alternative to the photographic film there are presently offered two measuring methods employing counter tubes for the registration of X-ray diffraction diagrams. The first method is based on the principle that the surface which is to be measured is scanned through the intermediary of a detector and the activity at the current measuring location is registered over a predetermined time interval. In this manner there can be achieved a good positional or localized resolution capacity, however, only under the assumption that, during the entire duration of measurement, there is no change in the diffraction characteristics of the preparation which produces the X-ray spectrum. Moreover, no intensity fluctuations may occur in the X-ray light source. Consequently, discussed hereby is a timewise short resolution capacity for this measuring method.

The second method operates with a number of detectors, which concurrently measure the intensity distribution for a predetermined area of the registration plane. However, the advantage of the good timewise resolution must be bought in conjunction with a deterioration in the positional or localized resolution, which is restricted through the measurements of the individual detectors. Furthermore, an added disadvantage herein lies in the great complexity of the apparatus.

Recently, attempts have been made to develop detectors which not only register the particles (quantum), but which will concurrently provide information with respect to the measured location. The efforts were exerted in a direction to make the positional or localized resolution of these detectors as good as possible, so as to be able to compete with the resolution of the film. In actual use, such a detector would be superior to a film since the dynamic range of a detector is considerably better than that of a film, namely, by a factor of $10^3$. In addition thereto, a measured spectrum is immediately present in the form of data acceptable to a computer whereas, in contrast therewith, a film must be first developed and thereafter the intensity distribution must be determined photometrically. Moreover, at a good efficiency of the detectors one can hope to obtain a reduction in the measuring time.

It has also been attempted to find a compromise of the two above-mentioned methods, in which a plurality of counter tubes were arranged as detectors in the measuring plane. Each individual one of these counter tubes delivers a positional information along its counter tube wire in which the final time duration of the discharge, which proceeds from the location of the primary avalanche to the wire ends, is employed as the measure for the location of the irradiation. Also refined evaluation techniques, for instance, through quotient formulation of the impluses obtained at both sides of the ends of a counter tube wire of a proportional counter tube, still did not bring an adequate positional or localized resolution.

With the measurement of impulse rise time periods which depend upon the location of an ionizing X-ray quantum received on a high-ohmic counter tube wire of a proportional counter tube, there could be achieved a decisive improvement in the resolution. In this method there is employed a proportional counter tube with a high-ohmic counter tube wire which, together with the counter tube capacitance, represents a continuous low-pass. The charge on the wire location, which corresponds to the irradiation or incident beam location of the ionizing X-ray quantum, flows out over this continuous low-pass and generates a current impulse at the input capacitance of the preamplifier of the counter tube. The rise period of this impulse is dependent upon the length of the continuous low-pass through which there must flow the charge from the irradiation location to the counter tube end. In a counter tube of this type which has become known, the positional information is derived from impulses tapped off at both of the counter tube wire ends, which are initiated by an ionizing phenomenon, whereby the difference between the impulse rise time periods is a direct measure for the irradiation location. Thus, by means of a known counter tube having the above-mentioned construction being operated pursuant to this method, with an effective length of about 55 mm under the application of a collimated X-ray beam with a diameter of less than 100 μm, there can be achieved a local or positional resolution of 160 μm (half-value width of the positional signal).

This positional resolution of the counter tube can only be reached under normal pressure through the utilization of the extremely expensive xenon as the counter tube gas. On the other hand, a closed counter tube, which only reuires a single gas filling, is problematic since such a closed counter tube must be highly vacuum-tightly sealed and, prior to being filled with the counter tube gas, must be heated in a vacuum. However, the counter tube wire is pulled apart by the given expansion of the counter tube body due to its extrmemely low mechanical load capacity (carbon-coated quartz wire having a diameter of 24.5 μm). It is difficult to formulate a suitable clamping arrangement for the counter tube wire. Hereby, care must be exercised that no change in the capacitance is produced at the wire end, since these will have a disruptive effect on the counter tube impulses which are to be evaluated.

SUMMARY OF THE INVENTION

Accordingly, it is an object of the present invention to provide a proportional counter tube of the above-mentioned constructional type which is so improved that it is possible to achieve a high positional or location-sensitive resolution capability, possibly below 50 μm with the utilization of a relatively inexpensive counter tube gas, for example, 90% argon, 10% methane, even for the long-term operation of such a counter tube. Hitherto one was forced to dispose of closed counter tubes in their entirety upon damaging of the sensitive counter tube wire, and due to insulating problems occurring with time. The exchange of a damaged counter tube chamber with the continued utilization of its electronic amplifier elements brought decisively influential problems to the resolution capability, to be able to reproduce the same capacitative connection values of the counter tube wire.

In order to attain this object there is proposed a positionally- or location-sensitive proportional counter tube of the above-mentioned type, which is characterized in that the counting chamber is constructed as an openable pressurized chamber with inlet and outlet apertures for a counter tube gas under high pressure, and wherein the counter tube wire is detachably and exchangeably arranged by means of fastening arrangements located in the insulating member, as well as the counter tube wire ends presently being directly electrically connected at both ends thereof through the intermediary of the fastening arrangements with the input resistance of a preamplifier.

It has been indicated that the increase in the counter tube gas pressure increases the likelihood of an X-ray quantum entering through the counter tube window to ionize a gas atom and to thereby increase the quantum yield. It has further been indicated that for a throughflow under pressure, for example, a counter tube operating at 11 bar, the sought after resolution capability can be achieved. In the construction of the counter chamber as an openable high pressure chamber it has been ascertained as necessary to meet precautionary criteria for the exchangeability of the counter tube wire, since in the not to be precluded damaging of a counter tube wire, there no longer comes into consideration the disposal of the high pressure chamber.

In an advantageous embodiment of the invention, the insulating body consists of a high-voltage resistant and mechanically hard casting mass which is arranged in a recess within a support member, and wherein the support member is provided with a detachable cover portion having an aperture correponding in size to that of the counter tube window and which, in a high-pressure resistant manner, closes the counter tube chamber while concurrently supporting and sealing the foil. In a further embodiment of the invention, the support member is insertable into the exposure chamber of a housing member, in the exposure chamber there also being located the preamplifier and high-voltage connection means for the cathode-metal trough in the insulating body. The integration of the counter tube within a housing member together with the preamplifier installations creates a small-sized apparatus, which is important for its being built into an X-ray goniometer.

By means of the direct connection of the counter tube wire through the intermediary of the fastening arrangements to an input resistor of the preamplifier there are avoided the influences of disruptive capacitances. In a suitable configuration of the invention, the fastening arrangements for the counter tube wire each, respectively, consists of a sleeve cast into the casting mass of the insulating body centrally of the cathode cross-section and passing through the end wall of the insulating body, and a plug adapted to fit within the sleeve having one end of the counter tube wire fastened thereto, and whereby there is directly connected to the outer end of each sleeve projecting from the insulating body the input resistance of the preamplifier.

BRIEF DESCRIPTION OF THE DRAWINGS

Reference may now be had to an exemplary embodiment of an inventive counter tube described in connection with the following detailed description, taken in conjunction with the accompanying drawings; in which.

DETAILED DESCRIPTION

Figure 1:
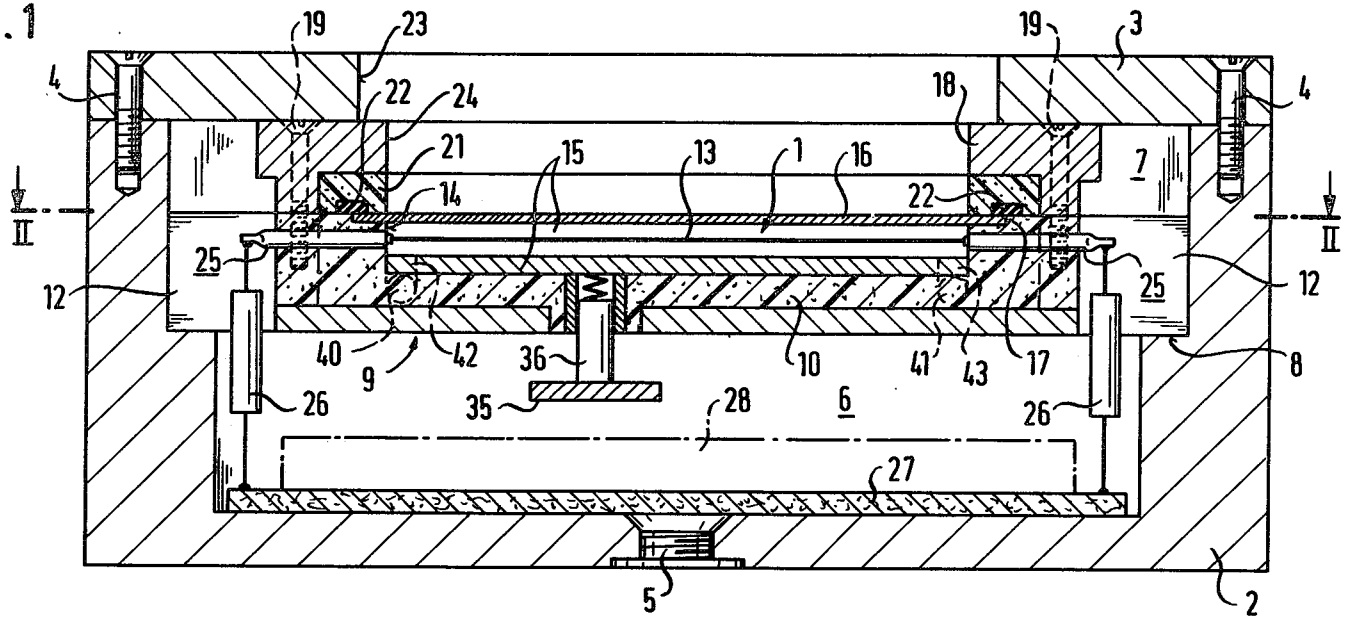
FIG. 1 illustrates a vertical section through a counter tube constructed pursuant to the invention.
Figure 2:
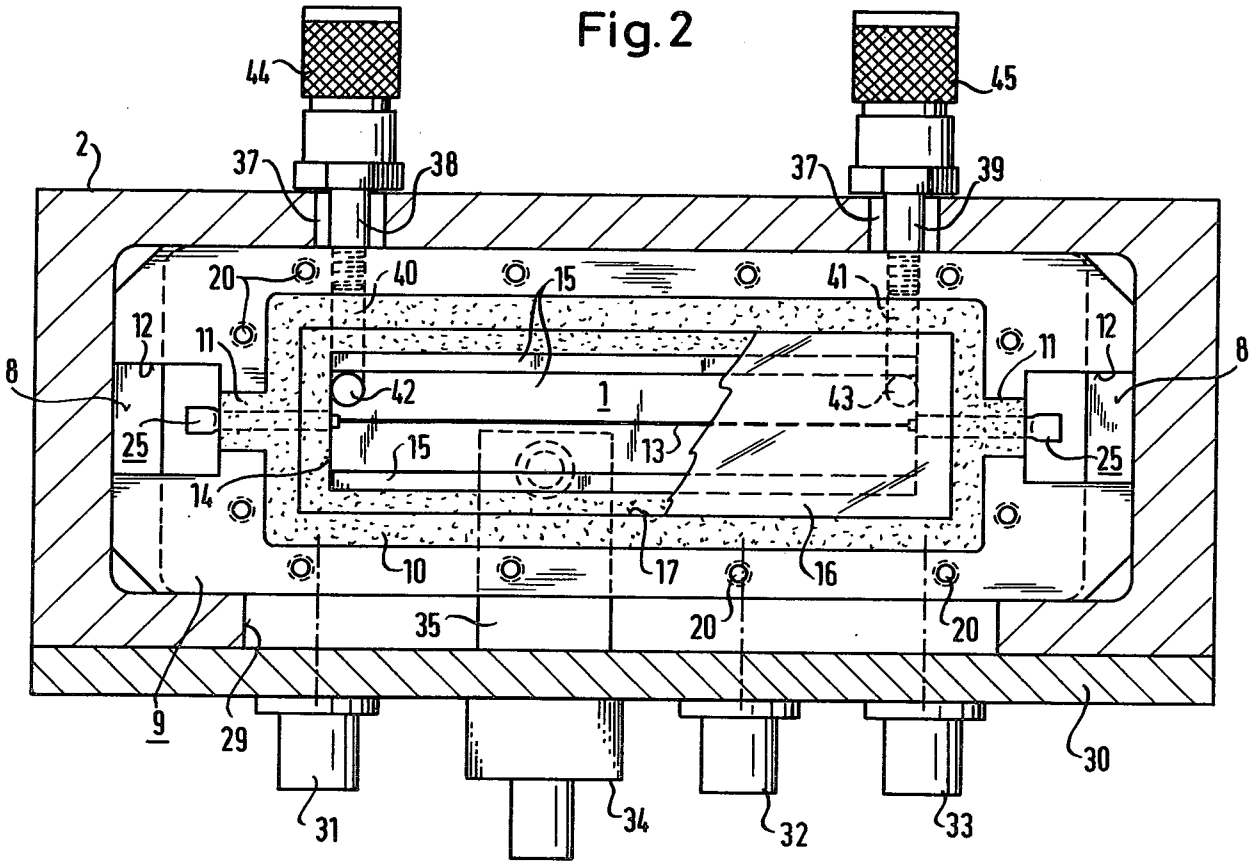
FIG. 2 is a sectional plan view taken along line 2—2 in FIG. 1.

As illustrated in FIGS. 1 and 2 of the drawings, the counter tube with its counting chamber 1 is located within a housing body 2, the latter of which can be closed by means of a cover 3 detachably fastened thereto by means of screws 4. The housing body 2 evidences a screw thread 5 on its base portion for the fastening of the entire counter tube to a vertical support or the like. Within the housing body 2 there is provided an exposure chamber which consists of a lower area 6 and an upper, somewhat wider area 7. Supported on a ledge 8 which separates the lower area 6 of the exposure chamber from its upper area 7 is a support member 9 which fits into the upper exposure chamber 7. Arranged within the support or carrier member 9 is a high-voltage resistant and mechanically rigid sealing compound or resin 10 which acts as the insulating body of the counter tube. As may be ascertained from FIG. 2, the sealing compound extends towards both sides of the support member 9 at 11 up to, respectively, a recess 12 formed in the support member 9, in order to facilitate the hereinbelow detailed electrical connection of the counter tube wire 13 under insulated extension out from the support member 9.

The counting chamber 1 is formed in a hollow 14 within the mechanically rigid sealing compound 10. Located within the hollow 14, as the cathode of the counter tube there is either inserted therein or vapor-deposited thereon a trough-shaped metallic layer 15. The counting chamber 1 is covered by means of a foil 16, for example, constituted of beryllium, which forms the counter tube window. The foil 16 is fitted into recesses 17 in the sealing compound at the upper edge of the counting chamber 1, and is retained by a cover portion 18 arranged on the support member 9. The cover portion 18 is connected with the support member 9 in a pressure-resistant manner through the screws 19, as indicated in FIG. 1, which fit into screw threads 20 as shown in FIG. 2. Arranged as an insert in a recess of the cover portion 18 there is provided a mechanically rigid and electrically high-voltage resistant sealing compound 21, in which a seal 22 is located in a groove lying over the interstice between the foil 16 in its recess 17 in the sealing compound 10. The counting chamber 1 is thereby closed in a pressure-resistant manner, and the foil 16 of the counter tube window is insulatingly fastened and retained with respect to the support member 9. The cover 3 of the housing body 2 lies on the cover portion 18 in the condition of support member 9 being inserted in the upper area 7 of the recess of the housing body 2, and fixes the support member 9 in the housing body 2. The cover portion 18, as well as the cover 3, have presently an aperture 23 and, respectively, 24 which correspond to the size of the counter tube window in order to facilitate the unhindered access of the radiation which is to be measured to the foil 16 of the counter tube window.

The counter tube wire 13 which is mounted equidistantly with regard to the walls of the cathode-metal trough 15 and the counter tube window 16, but equidistantly displaced against the trough back wall, is retained at its end by means of fastening arrangements 25 described in greater detail hereinbelow with reference to FIG. 3 of the drawings, and which are cast into the sealing compound 10. Connected directly to and electrically with the ends of the fastening arrangements 25 which project externally from the sealing compound 10 into the recesses 12 of the support member 9 are respectively the input resistors 26 of preamplifiers (not shown). The input resistors 26 project downwardly into the lower area 6 of the housing body 2 towards a plate 27 on which there are arranged the amplifier devices 28, schematically shown through only one line. As may be ascertained from FIG. 2, the side of the housing body 2 is provided with an aperture 29 which is closeable through the application of a plate 30, in which there are arranged the schematically illustrated electrical contacts. The electrical inlets and outlets for the amplifiers are designated by reference numerals 31, 32 and 33. Designated by reference numeral 34 is a high-voltage connector, which is connected with a contact plate 35 located within the lower area 6 of the hollow of the housing body 2. Arranged in a bore within the support member 9, and insulated with respect to the latter, is a spring-loaded contact pin 36 which is electrically connected with the cathode-metal trough 15 so that the latter is adapted to receive by means of the connector 35 opposite the counter tube wire 13 a negatively biased high voltage. Provided on the side of the housing body 2 opposite the aperture 29 are upwardly opening apertures 37 through which there extend conduits 38, 39 inserted in the support member 9. Within the support member 9 there continue the conduits 38, 39 in passageways 40, 41, which also traverse the sealing compound 10 and terminate in an inlet aperture 42, or respectively, outlet aperture 43 on the base of the metal trough 15 of the counting chamber 1, so that the counting chamber 1 can have counting chamber gas transmitted thereto in throughflow relationship. The outer ends of the conduits 30, respectively 19, support known self-sealing rapid or snap closures 44, 45 for the connection of the gas infeed and outlet. Since the snap closures 44, 45 are self-sealing, after suitable gas filling of the counting chamber 1, the counter tube can also be operated under static counter tube gas pressure.

Figure 3:
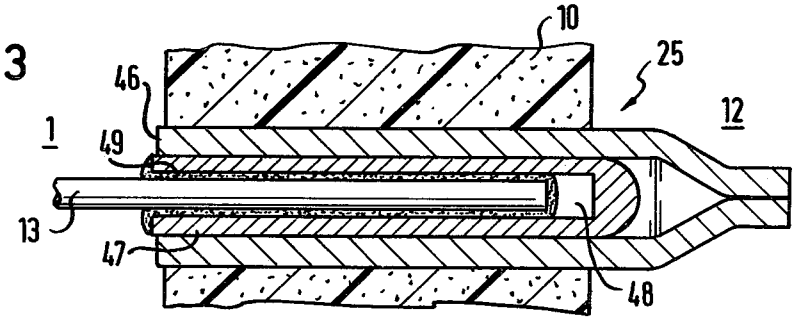
FIG. 3 is an enlarged scale schematic sectional view of one of the fastening arrangements for the counter tube wire.

The fastening arrangement 25 for the counter tube wire 13, which is illustrated on an enlarged scale in FIG. 3, encompasses a sleeve 46 which is cast into the sealing compound or resin 10, which at its end projecting externally into the recess 12 of the support member 9 is compressed or crushed and electrically connected with the input resistor 26. A plug 47 is inserted into the sleeve 46 in the side of the counting chamber 1, and which evidences a bore 48 whose diameter is only slightly larger than the diameter of the counter tube wire 13. The counter tube wire 13 carries at the end thereof, which is intended to be fitted into the bore 48 of the plug 47, a thin metal coating 49 which, in turn, is soldered in the bore 48 of the sleeve 47. In this manner it is possible that the quartz wire, which cannot be soldered and which is utilized as the counter tube wire 13, can be connected with the plug whereby, through the bore 48 in the plug 47 and the precise guidance of plug 47 in the sleeve 46 there is afforded a precise adjustment and mounting of the counter tube wire 13 in the counting chamber 1. Nevertheless, it is possible to effect a replacement of the counter tube wire 13 through the pulling out of the plugs 47 from the sleeves 46 and the replacement by another counter tube wire with correspondingly arranged plugs 47 at its ends. Hereby, it may be noted that the illustrated representation, in particular the counter tube wire 13, is largely exaggerated in contrast with the other components at the counter tube, since the counter tube wire has a diameter of only about 25 μm.

As indicated hereinabove, the counter tube wire 13 may be formed of a carbon-coated quartz wire, whereas the plugs 47 and sleeves 46 may be constituted of gold-plated brass, the cathode-metal trough 15 of aluminum, the foil 16 of a beryllium sheet, and the casting mass of the insulating body 10 of an epoxy-based synthetic resin.

What is claimed is:

1. In a positionally-sensitive proportional counter tube of high resolution having a counting chamber having a longitudinal direction; an insulating member forming a part of said counting chamber; a trough-shaped metallic layer lining said insulating member to form a cathode; a counter tube window extending along a longitudinal side of said counting chamber; a radiation transmissive foil gas-tightly covering said window; and a counter tube wire forming an anode, said wire traversing said counting chamber in the longitudinal direction thereof and being mounted equidistantly spaced from said metallic trough side walls and being fastened at both ends thereof to the electrical elements of preamplifiers, the improvement comprising: said counting chamber having means providing for the opening of the high-pressure chamber to facilitate repair of the tube, and having inlet and outlet apertures for a counter tube gas under high pressure, said counter tube wire ends being directly electrically connected at both ends thereof through the intermediary of fastening means in said insulating member with, respectively, an input resistor of a preamplifier, said counter tube wire being detachably and exchangeably fastened at both ends thereof by said fastening means which comprises at each end of the tube a sleeve cast into said insulating member centrally of the cathode trough cross-section and extending through the end wall of said insulating member; and plug means adapted to engage in each of said sleeves and having one end of said counter tube wire fastened thereto, with the outer end of each sleeve projecting from said insulating member being directly connected to said input resistor of said preamplifier.

2. A counter tube as claimed in claim 1, said insulating member being constituted of a high-voltage resistant and mechanically hard casting mass; a support member having a recess; said insulating member being supported within said recess; a detachable cover portion for said support member having an aperture therethrough in conformance with the dimensions of said counter tube window, said cover portion being adapted to high-pressure resistantly seal said counting chamber while concurrently retaining and sealing said foil.

3. A counter tube as claimed in claim 2, comprising a housing body having an exposure chamber, said support member being inserted into said exposure chamber; and preamplifier and high-voltage connecting means for said cathode-metal trough in said insulating member being arranged within said exposure chamber.

4. A counter tube as claimed in claim 1, comprising a metal coating being provided on the counter tube wire ends; a central bore being formed in each said plug means, said wire ends being soldered in said bores.

5. A counter tube as claimed in claim 2, comprising a recess being formed in the upper edge of said insulating member bordering said counting chamber, said recess having a depth corresponding to the thickness of said foil forming said counter tube window, said cover portion of the support member having an insert formed along the lower surface thereof encompassing the aperture conforming to said counter tube window, said insert being formed of a high-voltage resistant and mechanically hard casting mass having a groove therein; a pressure seal being press-fitted into said groove and adapted to press against the joint between the recess and the foil located therein when said cover portion is in a fastened condition.

6. A counter tube as claimed in claim 3, said exposure chamber in said housing body including an upper widened region for the closely-engaging receipt of said support member and a lower region for the receipt of a plate for said preamplifier, said input resistors extending from the sleeves projecting from the end walls of said insulating member towards said plate.

7. A counter tube as claimed in claim 6, said high-voltage connecting means comprising a resilient pin arranged at the lower surface of said support member, said pin being electrically connected with said cathode-metal trough; and a contact plate in the lower region of said exposure chamber connected to a high-voltage source being engaged by said pin when said support member is inserted into the exposure chamber of said housing body.

8. A counter tube as claimed in claim 2, comprising passageways in said insulating member and continuing in said support member, said passageways communicating with said inlet and outlet apertures of the counting chamber and being connected with connector conduits; and self-sealing snap closures being attached to said connector conduits.

9. A counter tube as claimed in claim 1, said counter tube wire comprising a carbon-coated quartz wire, said plug means and sleeves being formed of gold-plated brass, said cathode-metal trough being formed of aluminum, said foil being formed of a beryllium sheet, and the casting mass of said insulating member being constituted of an epoxy-based synthetic resin.

* * * * *